United States Patent [19]

Contino et al.

[11] Patent Number: 5,052,557

[45] Date of Patent: Oct. 1, 1991

[54] COMBINATION DISPLAY AND SHIPPING PACKAGE FOR BEVERAGEWARE

[75] Inventors: Frederic L. Contino; Robert Greathouse, both of Lancaster, Ohio

[73] Assignee: Newell Co., Freeport, Ill.

[21] Appl. No.: 395,909

[22] Filed: Aug. 18, 1989

[51] Int. Cl.[5] ..... B65D 65/00

[52] U.S. Cl. ..... 206/427; 206/45.34; 206/142; 206/196; 206/503; 206/510; 206/509; 206/470; 229/2.5 R

[58] Field of Search ..... 206/45.34, 142, 143, 206/144, 193, 196, 199, 203, 303, 492, 490, 497, 510, 499, 427, 423, 822, 432, 516, 503, 509, 470; 229/115, 116, 2.5 R; 220/DIG. 13

[56] References Cited

U.S. PATENT DOCUMENTS

| | | | |
|---|---|---|---|
| 2,888,164 | 5/1959 | Corwin | 206/510 |
| 2,893,550 | 7/1959 | Sandmeyer | 206/499 |
| 3,016,182 | 1/1962 | Chidsey, Jr. | 206/196 |
| 3,055,497 | 9/1962 | Brunsing | 206/459 |
| 3,258,190 | 6/1966 | Wood | 206/196 |
| 3,333,729 | 8/1967 | Rabb | 206/196 |
| 3,587,838 | 6/1971 | Miyata | 206/45.34 |
| 3,587,915 | 6/1971 | Theobald | 206/510 |
| 3,677,774 | 7/1972 | Rausing | 206/432 |
| 3,800,998 | 4/1974 | Gask | 206/45.34 |
| 3,812,962 | 5/1974 | Cunningham | 206/427 |
| 3,948,392 | 4/1976 | Faust | 206/432 |
| 3,954,177 | 5/1976 | Faust | 206/432 |
| 4,204,596 | 5/1980 | Davis | 206/139 |
| 4,416,373 | 11/1983 | de Larosiere | 206/432 |
| 4,732,273 | 3/1988 | DeMarco | 229/2.5 R |
| 4,840,276 | 6/1989 | George | 206/499 |

FOREIGN PATENT DOCUMENTS

| | | | |
|---|---|---|---|
| 2257197 | 6/1970 | France | 206/427 |
| 358554 | 1/1962 | Switzerland | 206/427 |
| 453195 | 6/1968 | Switzerland | 229/2.5 R |
| 1441246 | 6/1976 | United Kingdom | 206/427 |

*Primary Examiner*—David T. Fidei
*Attorney, Agent, or Firm*—James G. Staples

[57] ABSTRACT

A shipping package for beverageware which functions to also display the beverageware as it is offered for sale on retain shelves. The package is stackable with like packages during transit and handling at all points from the manufacturing source to the consumer's home, and can be thermoformed as one sheet with integral hinges and friction-type interlocks.

10 Claims, 5 Drawing Sheets

7
8
11
12
13
14
17
19
20
21
22
23
25
26
27
28
28A
29
29A
30
31
32
33
34
35
36
40
41
42
43
44
45
46
47
48
49

COMBINATION DISPLAY AND SHIPPING PACKAGE FOR BEVERAGEWARE

This invention relates generally to packaging, and specifically to a beverageware package which allows the consumer to see the beverageware as it is displayed for sale on retail shelves, and, at the same time, function as a shipping container which is securely stackal,le with like structures during transit and handling at all points from manufacturing to the retail shelf to the consumer's home. The combined shipping and display package is particularly well adapted for use with glass beverageware, such as, for example, 8-ounce tumblers, but it should be understood that it is usable with a wide variety of both sturdy and fragile beverageware.

BACKGROUND OF THE INVENTION

Current technology in the beverageware, and particularly the glassware, package art has not provided structures which allow a consumer to adequately see such beverageware on retail shelves. Since much of such beverageware is sold on an impulse basis it is very important that the beverageware have maximum visual exposure to the eye of the retail consumer in order to affect a decision to purchase. Ideally, the beverageware should be seen clearly from 360 degrees in all planes, but this is seldom achieved, and, if achieved, is done so at the expense of stackability or other desirable features.

It is also important that the beverageware packages be stackable one atop another since retail shelving systems are seldom of such a size as to accommodate only one layer of beverageware packages per shelf, and hence stacking of one beverageware package atop another is most conducive to efficient use of retail shelf space and economy of handling at the retail level, not to mention economy of handling at the production and distribution stages prior to reaching the retail shelves.

Inherent in stackability is the matter of securement of one beverageware package to another. Simple flat top and bottom packages are stackable in the sense that they will sit atop one another to a consider height if placed upon a flat surface. However, such flat bottom and top packages are not secure in the sense that an unsecuring force, such as vibration or a sideways directed jarring force, can cause an upper package so stacked to be easily dislodged from its vertical, flat stacked position. Hence it is desirable that, in addition to being simply stackable, a beverageware package be securable to similar packages located above and below so that dislodgement forces will not result in tipping and consequent breakage of the contents of the beverageware package.

And it is highly desirable that, if at all possible, in addition to the foregoing characteristics of 360 degree visual access, stackability and securability, a shipping and display package form a dust and dirt free environment for the beverageware so that the product purchased retains its luster and eye pleasing ability long after manufacture; many beverageware items have designs or other eye pleasing graphics incorporated in their shape and/or surface which have great eye appeal and hence sales appeal, and it is important that such eye appeal not be obscured or be detracted from in any way by dust and dirt in the atmosphere which collects on the beverageware.

With increasing competitiveness in the marketplace it is also important that, in addition to meeting the above requirements, the manufacturing costs of such packaging be as low in cost as possible, both in terms of raw material and manufacturing processing costs.

Thus, the prior art has not, to our knowledge, provided a see-through glass beverageware package which can be viewed by the consumer from 360 degrees in all planes, provides excellent stackability and securement of one package to another, and, if desired, can provide a dirt and dust free environment and/or be manufactured by rapid, low cost manufacturing techniques such as one-piece injection molding or thermoforming.

SUMMARY OF THE INVENTION

The beverageware package of this invention meets all of the shortcomings of the prior art in that 360 degree visibility in all planes is provided, the package is securely stackable from immediately after the moment of filling to the consumer's home, is of minimal cost, by current standards, is exceedingly simple in construction in that it preferably consists of only one part and, with virtually no added costs, provides a dirt and dust free environment for the beverageware displayed for sale by the retail merchant to the ultimate consumer.

These and other features, advantages and characteristics of the invention are disclosed in the following exemplary description of a preferred embodiment of . the invention.

BRIEF OF DESCRIPTION OF THE DRAWING

The invention is illustrated more or less diagrammatically in the accompanying drawing where:

DETAILED DESCRIPTION OF THE INVENTION

Figure 1:
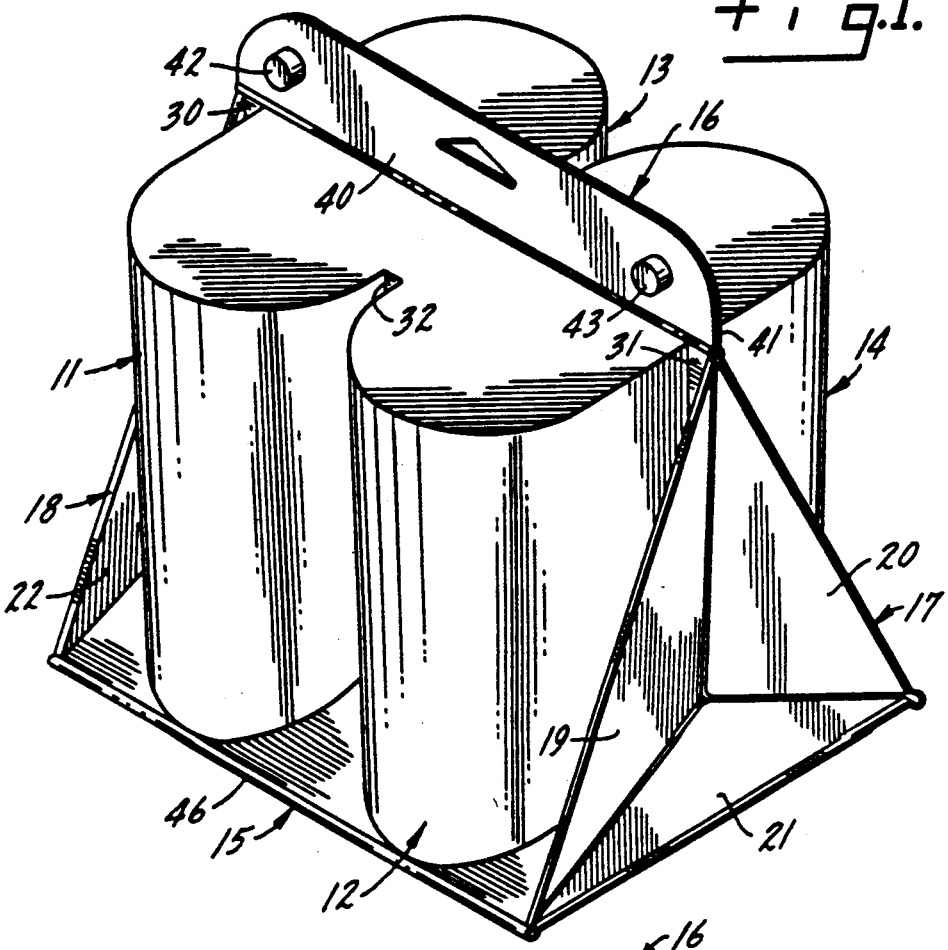
FIG. 1 is a perspective view in closed condition of the combined shipping and display beverageware package of this invention with the beverageware, such as glassware, omitted for ease of understanding.

In describing the invention in detail, like reference numbers will be used to indicate like or similar parts from Figure to Figure of the drawing.

The combined shipping and display beverageware package, hereafter, when the context indicates, the "package," of this invention is indicated generally at 10 in FIG. 1. It is illustrated in its assembled condition as it would appear to the eye of an observer, such as a consumer in a retail store, who looked in its direction in contemplatio. f buying beverageware, such as, in this instance, four tall glasses which are located inside the package.

In its assembled condition the package includes four display modules, indicated generally at 11, 12, 13 and 14 which project upwardly from a bottom structure, indicated generally at 15, and which terminate beneath a combined handle, display and stacking structure indicated generally at 16, hereafter, when the context indicates, "stacking handle."

The right side wall is indicated generally at 17, and left side wall is indicated generally at 18. Right side wall includes upper movable sections 19 and 20, and lower stationary section 21. "Movable" is used in the sense that the sections move from an extended, open position, best seen in FIG. 5, just prior to filling, to an assembled, closed position, best seen in FIG. 1. "Stationary" is used in the sense that the position of section 21 is in the same relative position with respect to a support structure, such as a flat surface, in both the open, filling position of FIG. 5 and the closed, filled position of FIG. 1. The two upper movable sections of left wall 18 are indicated at 22 and 23, see FIG. 6, and the lower stationary section at 24, shown best in FIGS. 6, 7 and 8. The construction of left side wall 18 is identical to the construction of right side wall 17.

The bottom structure 15 consists of a pair of upwardly inclined planar surfaces 25 and 26 which meet at a center ridge indicated at 27. A pair of beverageware holding depressions or receptacles are indicated at 28 and 28A in left upwardly inclined surface 25, and another pair of receptacles are indicated at 29 and 29A in right upwardly inclined surface 26.

Figure 2:
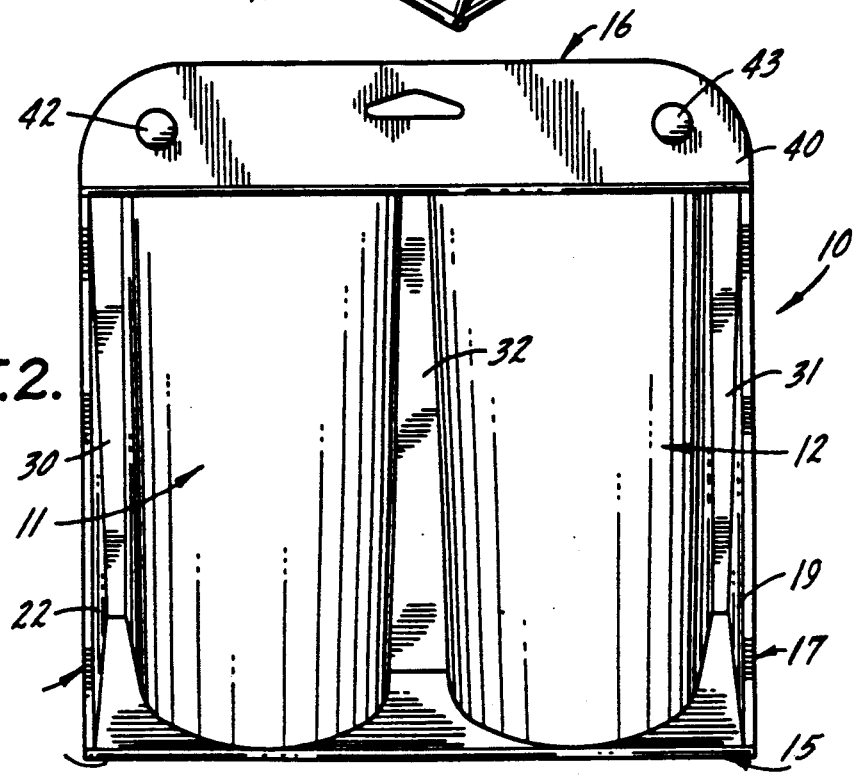
FIG. 2 is a front elevation of the combined shipping and display beverageware package of FIG. 1.
Figure 3:
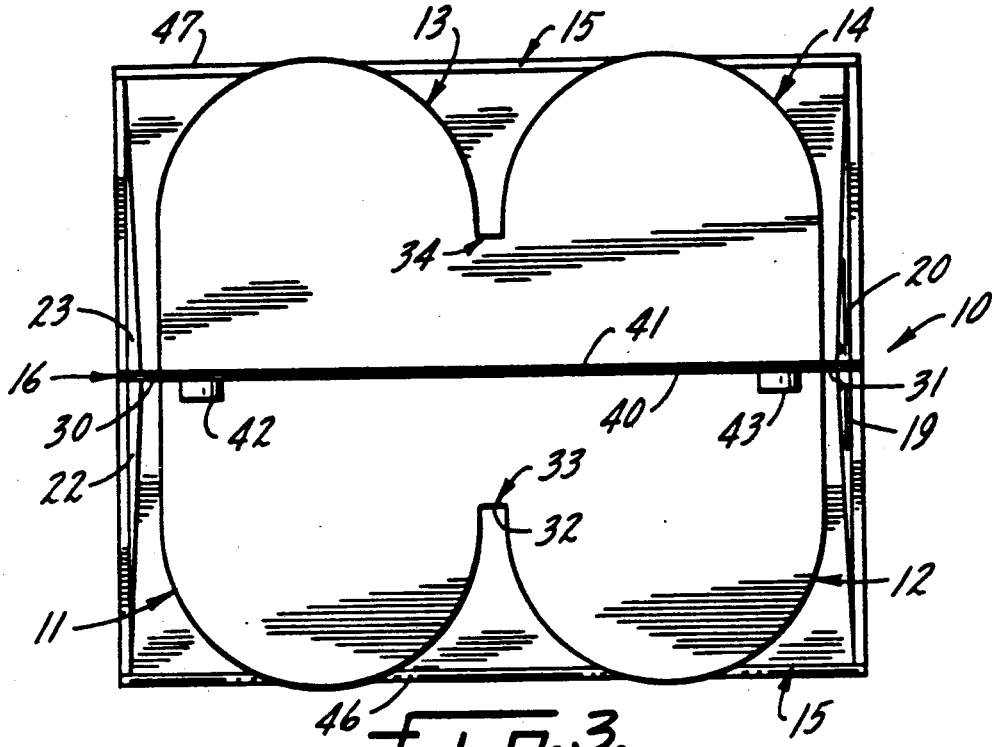
FIG. 3 is a top plan view of the combined shipping and display beverageware package of FIG. 1.

Display modules 11, 12 and 13, 14 are generally semicylindrical in contour as best seen in FIGS. 1-3. Modules 11 and 12 form, in effect, two bulges in a left wall structure which includes left and right sections 30 and 31 and center section 32, as viewed in FIGS. 1-3. It should be noted that upwardly inclined planar surface 25 also forms, in effect, the lower portion of the left wall section which includes display modules 11 and 12. From FIGS. 1 and 3 it will be noted that center section 32 terminates closer to the extreme left edge of the package than does the left and right sections 30, 31 as best seen in FIGS. 1 and 3. In the filling position of FIG. 6, the inner facing surfaces of modules 11 and 12 form a ridge indicated generally at 33, which preferably faces a similar ridge indicated generally at 34 between modules 13 and 14 when the package is assembled as shown in FIGS. 1 and 3. The rear wall includes a left section 35 and a right section 36, see FIG. 6, which meet in a butting relationship with right section 31 and left section 30, respectively, of the front wall when the package is assembled as shown in FIGS. 1 and 3.

The tops of display modules 11 and 12, and 13 and 14, are closed as best seen in FIG. 1. In this instance the top of each module is co-planar with all other modules, and also with the upper surface which is aligned with the center section 32 which forms ridge 33 of the front wall. Such a construction provides maximum visual access to the contents of the modules since no angles are present to distract the eye from the displayed beverageware inside. It should be noted however that said upper surface associated with center section 32 could be at a different elevation than the adjacent upper surface of modules 11 and 12.

Figure 4:
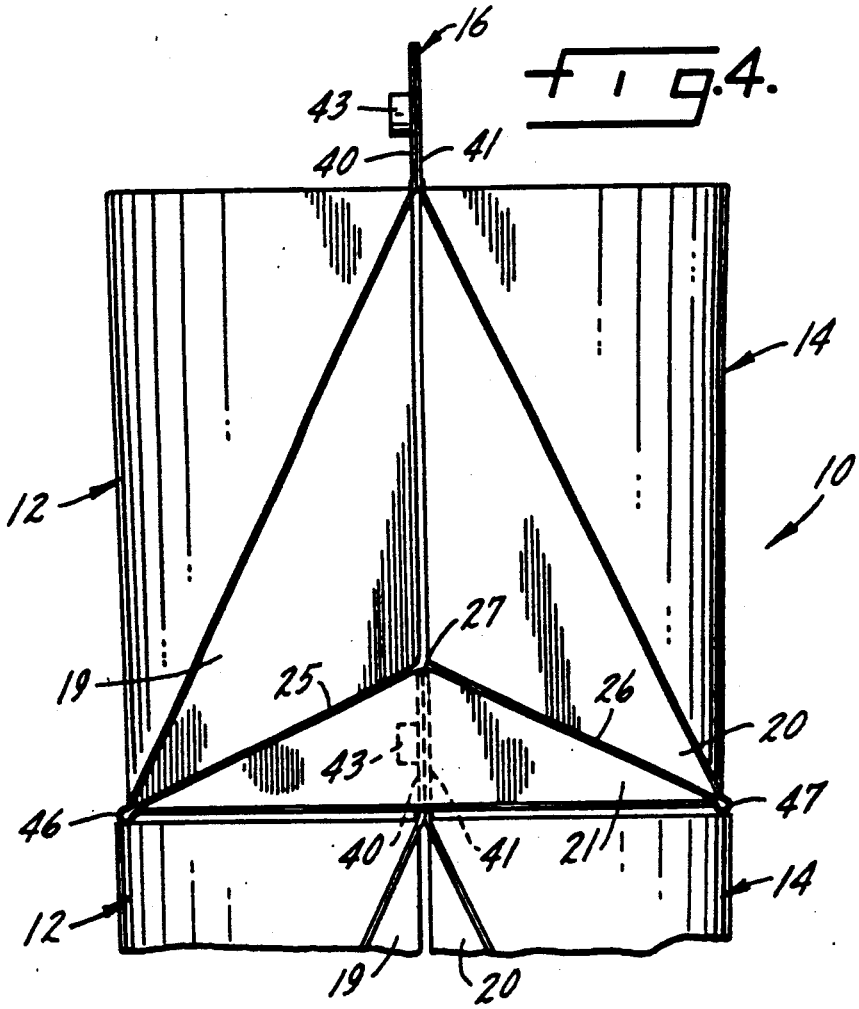
FIG. 4 is a right side elevation of the combined shipping and display beverageware package of FIG. 1.
Figures 5, 6:
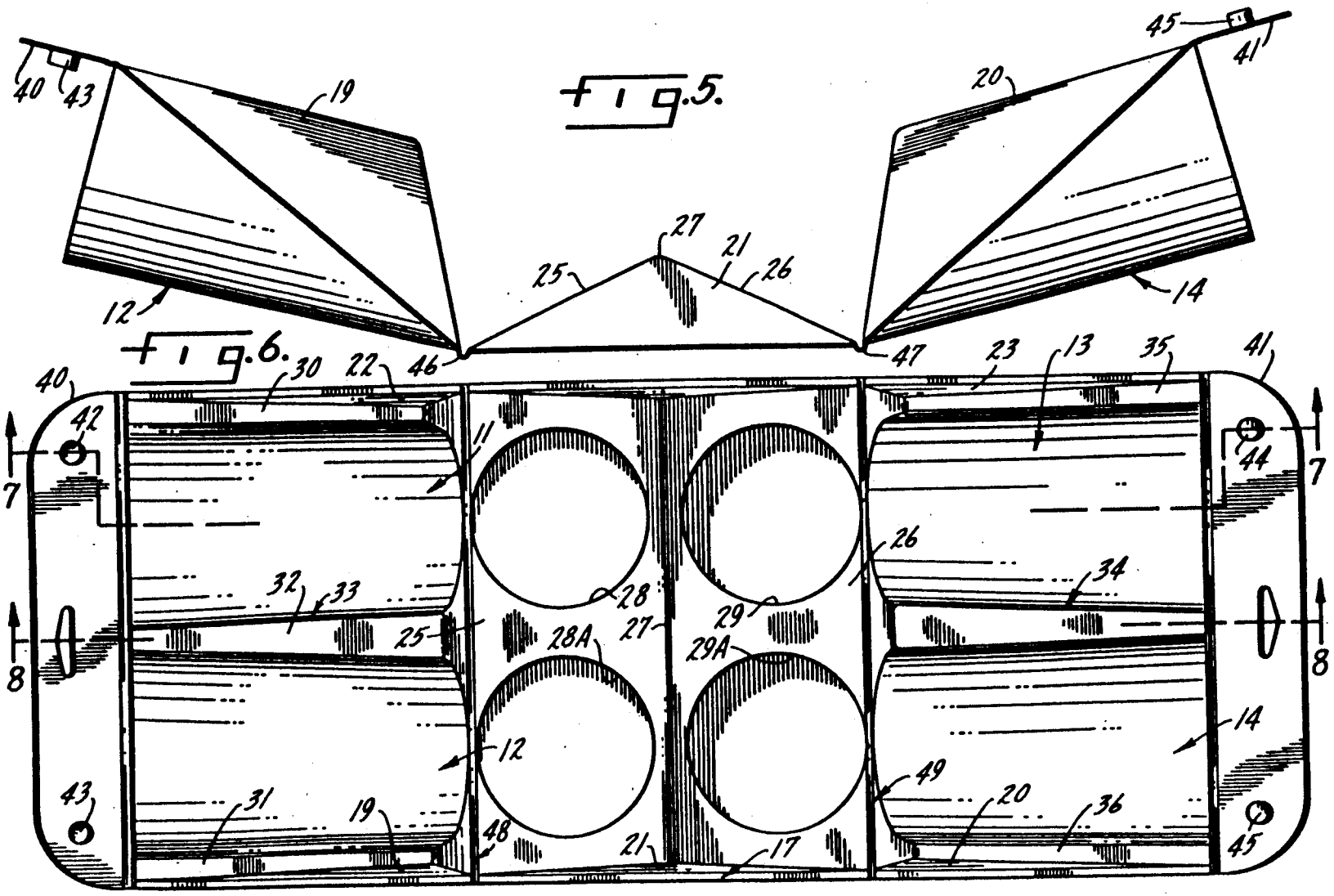
FIG. 5 is a side elevation of the combined shipping and display beverageware package of this invention shown in an open condition preparatory to being filled with beverageware, such as glassware.
FIG. 6 is a top plan view of the open shipping and display beverageware package of FIG. 5.

The front and back walls terminate, at their upper end portions, in flange sections 40 and 41 which are identical in outline as shown best in FIGS. 1, 2 and 6 and which, taken together, form a stacking handle. In this instance, a pair of securing pin receptacles are indicated at 42 and 43 in the front wall, and a pair of securing pins are indicated at 44, 45 in the back wall. As seen in FIGS. 1-6, the securing pins 44, 45 are snugly received in securing pin receptacles 42, 43, respectively when the package is moved from the open position of FIG. 6 to the closed position of FIGS. 1-4.

Referring now particularly to FIG. 4, the secure stacking feature of the invention is there illustrated. Specifically, it should be noted that the height by which the two butting flanges 40 and 41 project above the flat tops of the display modules 11-14 is so selected that when one package is stacked atop another, as seen in FIG. 4, the upper edge formed by the two butting flanges will just make contact with the underside of the center ridge 27. At the same time, the lower front and rear edges indicated generally at 46, 47 of the front and rear extremities of an upper package will rest upon the tops of the display modules 11-14. Since the pin and receptacle connections 42, 44 and 43, 45 are located near the outer edges of the assembled package, they easily clear the beverageware as indicated in dotted outline in an exemplary fashion in FIG. 4.

Figure 7:
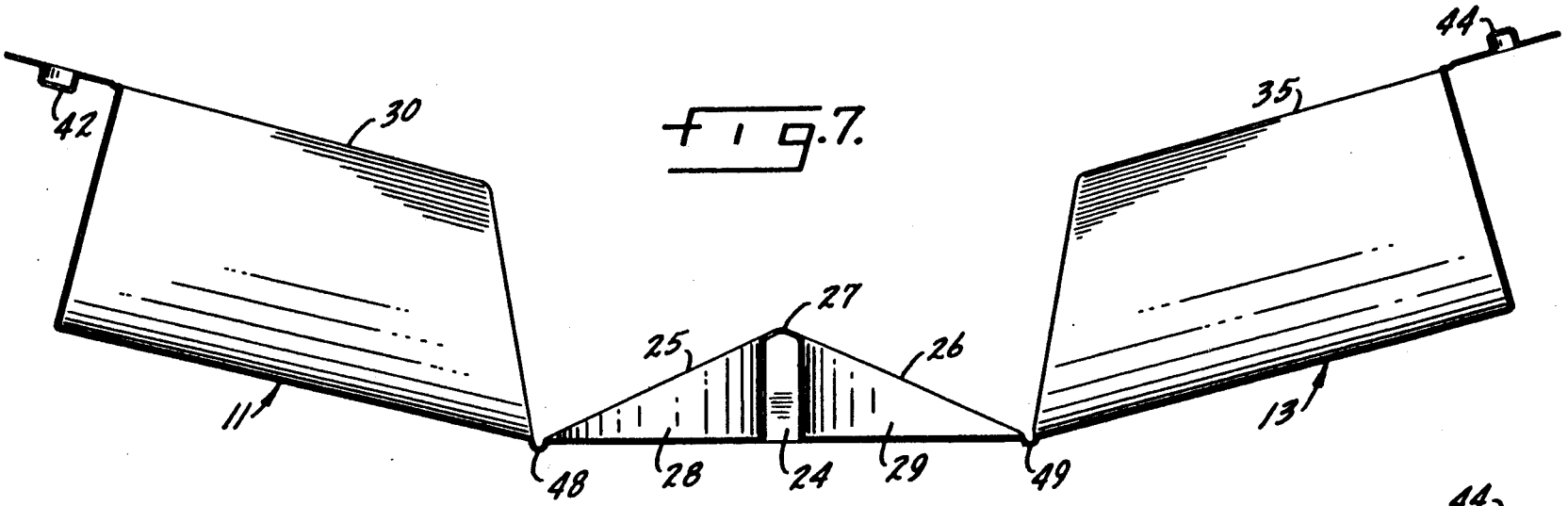
FIG. 7 is a section view taken substantially along line 7—7 of FIG. 6.
Figure 8:
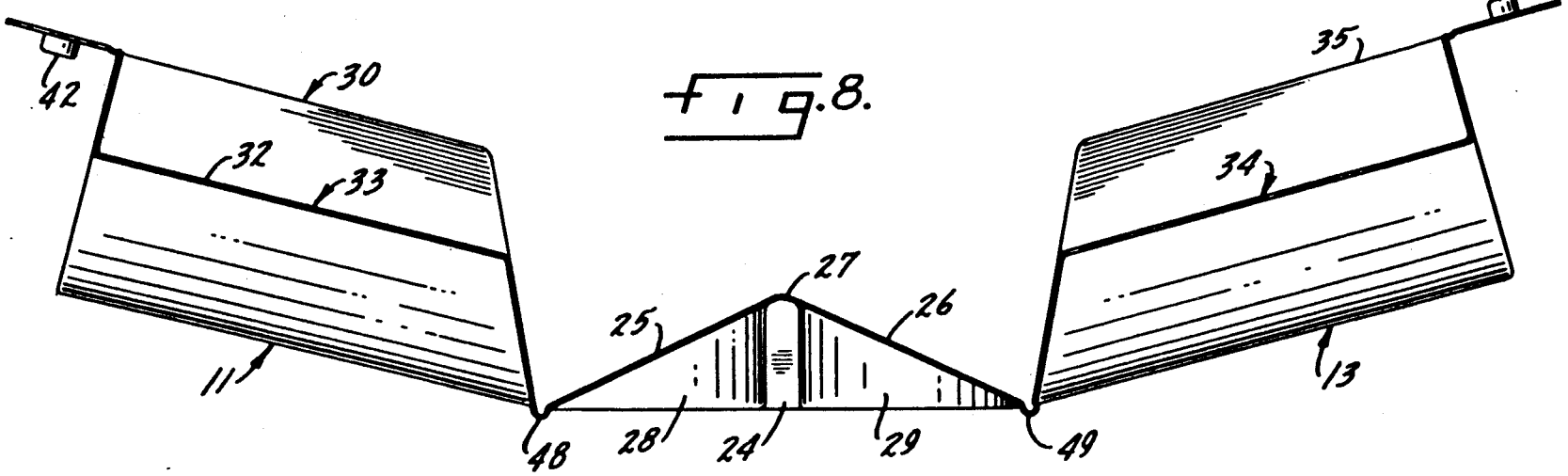
FIG. 8 is a section view taken substantially along line 8—8 of FIG. 6.

It will be noted that the package of this invention is of one piece construction as can be seen best in FIGS. 6-8. As one specific embodiment, the package may be made from transparent PVC plastic, and formed in either a plastic injection mold or by thermoforming. In line with good forming practice, integral hinges 48 and 49 are formed at the junction between the bottom 15 and the front and rear sections. If formed in the position of FIG. 7 and 8, the front and rear sections will tend to return to the positions of FIGS. 7 and 8 when the package is opened by the consumer to remove the beverageware, thus presenting the beverageware for easy removal. It will be understood of course that the receptacles 28-29A will be so designed with respect to the lower portion of the beverageware to be shipped and displayed that there will be a snug friction fit between the receptacles and the beverageware. Likewise, the dimensions of the securing pins and their receptacles 42 and 43 will be so designed as to make a snug friction fit which will have sufficient tightness to preclude unintended detachment during handling following shipping, even when an open biasing force is designed into the hinges at the front and rear edges 46 and 47. And finally, the width dimension of the tops of the display modules as viewed in FIG. 4 should be slightly greater than the distance between edges 46 and 47 so that the hinges at 48 and 49 will rest on the tops of the displays modules at all times after flange sections 40, 41 are butted in place against the underside of center ridge 27. Preferably, each of the display modules 11-14 has a slight upwardly, outward taper.

Figure 9:
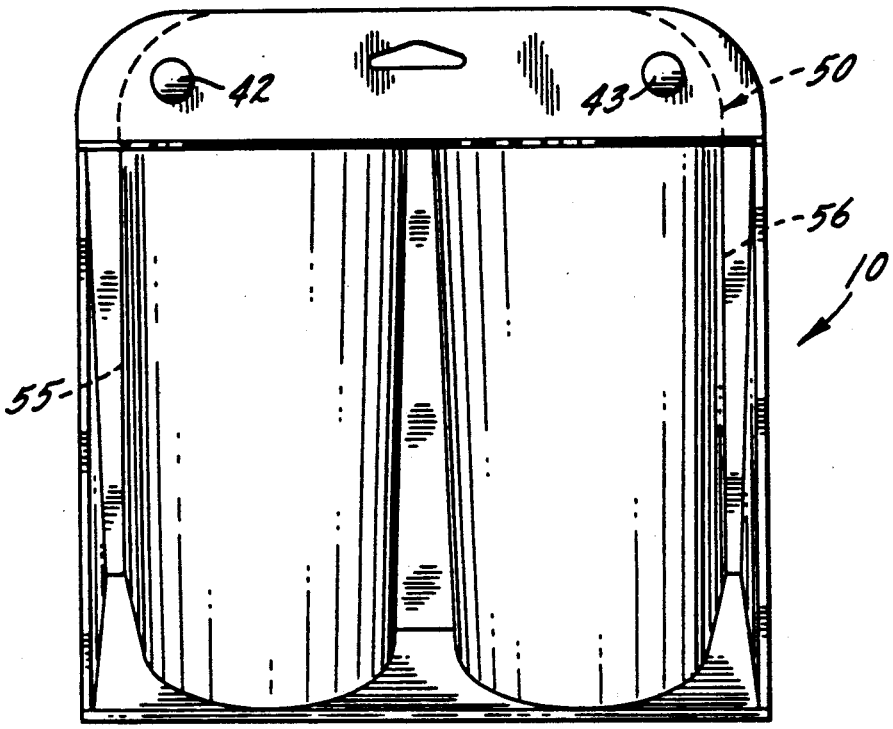
FIG. 9 is an elevation illustrating a further feature of the invention.
Figure 10:
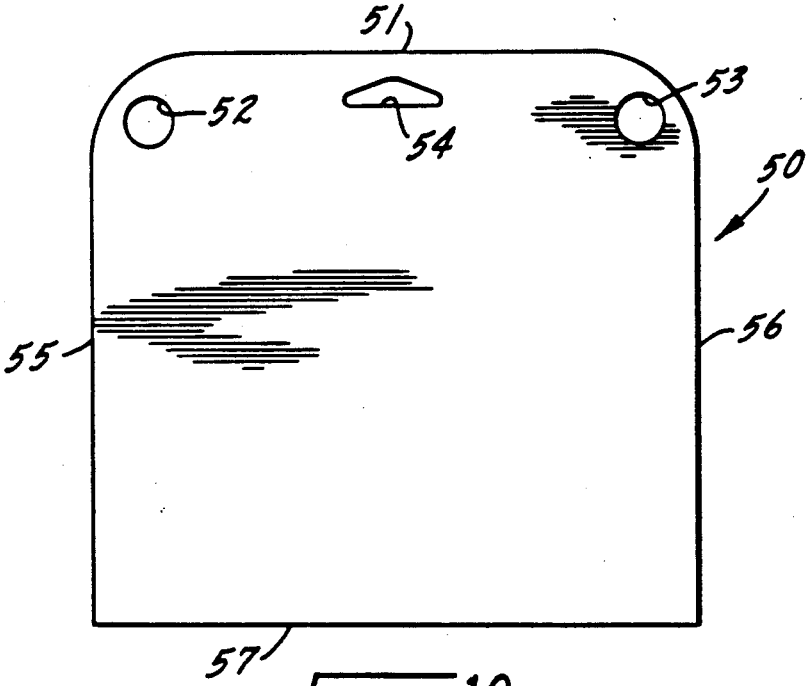
FIG. 10 is a side view of a protective, reinforcement and display insert.
Figure 11:
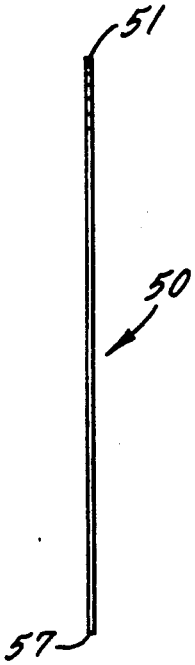
FIG. 11 is an edge view of the insert of FIG. 10.

Referring now to FIGS. 9-11 in particular, a variation of the invention, is there illustrated. In these Figures a protective reinforcement and display insert is indicated generally at 50. As can be best visualized from FIGS. 10 and 11, the height of the insert is preferably the distance between the center ridge 27 and the tops of flange sections 40 and 41, though, if desired, the upper edge 51 may extend above, or even, under some circumstances, somewhat below, the top edges of flange sections 40, 41. As best seen in FIG. 10, in the preferred variation, the portion of the insert which projects into the area defined by flange sections 40, 41 has apertures 53 to accommodate the securing pins 44, 45 when the receptive halves are swung upwardly into engagement. A supporting or hanging cut-out has been indicated at 54. It will be understood that when an insert 50 with a cut-out 54 is used, similarly located and configured cut-outs will be formed in the flange sections 40, 41 so that the entire package may be hung from a support instead of stacked.

The width of the insert may vary as desired. From FIG. 9 it will be noted that in this instance edges 55, 56 are located a distance apart equal to the outside edges of the side by side display modules and do not extend all the way to the outside of the left and right sections 30, 31. Preferably the bottom 57 of the insert rests on ridge 27. From a primary function standpoint it is only essential that the insert be present in the areas where the beverageware or other displayed items could make contact with one another during shipping and handling. The insert may be made of transparent material similar to the balance of the package or, more preferably, can be opaque paper board or a similar material. If desired, that portion of the insert which is located between flange sections 40, 41 may have text material printed thereon, which text will be visible through the transparent material of flange sections 40, 41. The portion of the insert beneath the flange sections may be opaque white.

The use and operation of the invention is as follows.

After forming, preferably in a single piece as shown in FIG. 5-8, beverageware to be shipped and displayed is loaded into the packages by engaging the lower portions of the beverageware with the receptacles 28, 28A, 29 and 29A. Thereafter the front and rear sections of the clam shell type structure illustrated in FIGS. 7 and 8 are swung upwardly toward one and other until the pins 44, 45 project into the pin receptacles 42, 43 with which they make a snug, frictional fit.

Thereafter, one package is stacked atop another, as illustrated in FIG. 4, with the upper edge formed by flange sections 40, 41 in supporting engagement with the underside of ridge 27.

In the variation shown in FIGS. 9-11 an insert 50 is used to protect the contained and displayed beverageware, such as glass tumblers, from knocking against one another at their upper edges and thereby chipping or cracking due to the inevitable shocks which the package will be subjected to during shipping and handling. The insert acts as a central reinforcement for the package by adding an extra layer of material and, as discussed above, the insert may be used for printed text to help display and advertise the contents.

After as many individual packages are stacked as is convenient to ship as a group, the stacked packages are secured by any convenient means, which may merely be placement in a shipping container, and shipped to a final destination. A band or other securement means may of course be placed around a group of packages, but this is not essential.

Upon arrival at a destination the shipping container is opened and the package is removed and stacked on a retail shelf for display and sale. The type, thickness and structural characteristics of the material of which the package is composed should be selected to have good forming qualities, provide clear vision to the package contents, and have sufficient strength and flexibility to be packed, handled and unpacked without any substantial risk of damage to the contents. Clear polyvinylchloride of about 0.025" thickness has proven quite satisfactory.

Alternatively, the variation shown in FIGS. 9-11 may be hung from any suitable suspension structure.

From the foregoing description it will at once be apparent to those skilled in the art that modifications may be made in the invention within the spirit and scope of the invention. Accordingly, it is intended that the scope of the invention be limited solely by the scope of the hereinafter appended claims, when construed in light of the relevant prior art, and not by the foregoing exemplary description.

We claim:

1. A one piece shipping and display package, said package having a lower section which includes means for securing and holding items to be shipped in spaced, fixed relationship one to another, first side wall means and second side wall means which, following filling of the package, form, with the lower section, a unitary, enclosed container within which is received items to be shipped, means for stacking a plurality of said containers vertically, one directly upon another, and means for securing one package to another package in contact with it which resists separation of the packages by forces acting in a direction to tip the stacked packages, said one piece shipping and display package being further characterized in that firstly, the means for receiving and holding items to be shipped includes a plurality of depressions of a size to receive items to be shipped with a snug friction fit, secondly, in that the exterior, central portion of the bottom of the lower section is spaced a given vertical distance above a plane on which the package rests to thereby form an open central portion which extends upwardly from said plane, thirdly, in that oppositely located outer edge portions of the upper end portions of the first and second side wall means are sufficiently widely spaced to provide a support surface for a similar package located thereabove, and fourthly, in that the first and second side wall means include securement means which project upwardly from said support surface a distance no greater than said vertical distance, said securement means being located in alignment with the open central portion of the bottom of a similar package located thereabove whereby a securement is provided between two vertically disposed packages which resists tipping forces.

2. The one piece shipping and display package of claim 1 further characterized in that the securement means is a flange formed when the edge portions of the first and second wall means abut one and other in a closed condition, and further including fastening means carried by said edge portions which, when in engagement, lock the lower section and the first and second wall means in fixed relationship to one another.

3. The one piece shipping and display package of claim 2 further characterized in that the first and second wall means are hinged to opposite sides of the lower section and are swingable from a normally open as-manufactured position into closed, abutting engagement with one and other about their respective hinges.

4. The one piece shipping and display package of claim 3 further characterized in that the material from which the package is made is sufficiently flexible to provide the requisite hingeing action.

5. The one piece shipping and display package of claim 4 further characterized in that when the side wall means are swung into engagement with one and other, the lower section and said side wall means form a closed container so as to provide a dirt and dust free interior in which the items to be shipped are located.

6. The one piece shipping and display package of claim 5 further characterized in that the side wall means and lower section are formed from clear plastic.

7. The one piece shipping and display package of claim 6 further characterized by and including an insert located between the side wall means which protects packaged items on either side of it from making contact with one another.

8. In a one piece shipping and display package which provides 360 degree visibility of the contents thereof in all planes, said package being stackable with similar packages disposed thereabove and therebelow, and having securement means which interlock with similar packages disposed thereabove and therebelow, the combination of a lower section, first side wall means and second side wall means which, following filling of the package, form, with the lower section, a unitary, enclosed container within which is received item to be shipped, oppositely located outer edge portions of the upper end portions of the first and second side wall means being sufficiently widely spaced to provide a support surface for a similar package located thereabove.

the exterior, central portion of the bottom of the lower section being spaced a given vertical distance above a plane on which the package rests when filled and closed to thereby form an open portion which extends upwardly from said plane, the upper end portions of the first and second side wall means forming securement means which project upwardly from said support surface a distance no greater than said vertical distance, said securement means, when extending upwardly into an open portion in an upper stacked package, thereby resisting separation and tipping of an upper package away from a next lower package.

9. The one piece shipping and display package of claim 8 further characterized in that said package forms a dirt and dust free environment when closed.

10. The one piece shipping and display package of claim 9 characterized in that said package, when filled and closed, provides 360 degree visibility to its interior in all planes.

* * * * *